US009192978B2

(12) United States Patent
Baba et al.

(10) Patent No.: US 9,192,978 B2
(45) Date of Patent: Nov. 24, 2015

(54) MANUFACTURING APPARATUS FOR FLATTENED TUBE FINS

(71) Applicant: HIDAKA SEIKI KABUSHIKI KAISHA, Tokyo (JP)

(72) Inventors: Hirofumi Baba, Tokyo (JP); Yasuhiro Endo, Kuwana (JP); Kazuyuki Tominaga, Kuwana (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 392 days.

(21) Appl. No.: 13/869,352

(22) Filed: Apr. 24, 2013

(65) Prior Publication Data

US 2014/0115881 A1 May 1, 2014

(30) Foreign Application Priority Data

Oct. 31, 2012 (JP) ..... 2012-239815

(51) Int. Cl.

| | |
|---|---|
| ***B21D 53/02*** | (2006.01) |
| *B21D 43/02* | (2006.01) |
| *B21D 43/04* | (2006.01) |
| *B21D 43/28* | (2006.01) |

(52) U.S. Cl.

CPC ..... *B21D 53/022* (2013.01); *B21D 43/02* (2013.01); *B21D 43/021* (2013.01); *B21D 43/023* (2013.01); *B21D 43/04* (2013.01); *B21D 43/28* (2013.01); *B21D 43/287* (2013.01); *Y10T 29/4938* (2015.01); *Y10T 29/49359* (2015.01); *Y10T 29/5197* (2015.01); *Y10T 29/5198* (2015.01); *Y10T 29/53122* (2015.01)

(58) Field of Classification Search

CPC .... B21D 43/006; B21D 43/02; B21D 43/021; B21D 43/022; B21D 43/026; B21D 43/027; B21D 43/04; B21D 43/05; B21D 43/11; B21D 43/10; B21D 43/287; B21D 43/023; B21D 43/028; Y10T 29/49359; Y10T 29/4938; Y10T 29/49373; Y10T 29/49378; Y10T 29/5198; Y10T 29/5197; Y10T 29/53122

See application file for complete search history.

(56) References Cited

U.S. PATENT DOCUMENTS 2,480,781 A * 8/1949 Simpson ..... 83/65
2,816,758 A * 12/1957 Danly ..... 242/420.4

(Continued)

FOREIGN PATENT DOCUMENTS

JP 49-111281 A 10/1974
JP 55-035781 A 3/1980

(Continued)

*Primary Examiner* — Jason L Vaughan

(74) *Attorney, Agent, or Firm* — Birch, Stewart, Kolasch & Birch, LLP

(57) ABSTRACT

A flattened tube fin manufacturing apparatus includes: a press apparatus; an inter-row slit apparatus forming metal strips of a product width that are arranged in the width direction; a first feeding apparatus feeding the metal strips cut by the inter-row slit apparatus downstream; a cutoff apparatus that cuts the metal strips formed by the inter-row slit apparatus into predetermined lengths to form flattened tube fins; and a second feeding apparatus that feeds the flattened tube fins downstream. The plurality of metal strips outputted from the inter-row slit apparatus advance into the cutoff apparatus after entering a downwardly sagging state. The flattened tube fin manufacturing apparatus further includes a control unit controlling a feeding amount of the second feeding apparatus based on a feeding amount of the first feeding apparatus.

3 Claims, 7 Drawing Sheets

(56) References Cited

U.S. PATENT DOCUMENTS

| | | | | |
|---|---|---|---|---|
| 2,900,143 | A * | 8/1959 | Bandy et al. | 242/418.1 |
| 3,023,976 | A * | 3/1962 | Paquay | 242/418.1 |
| 3,512,438 | A * | 5/1970 | Burdge | 83/209 |
| 3,839,974 | A * | 10/1974 | Freres | 72/185 |
| 4,464,916 | A * | 8/1984 | Grew et al. | 72/19.2 |
| 5,349,841 | A * | 9/1994 | Honma et al. | 72/333 |
| 9,009,953 | B2 * | 4/2015 | Ueda et al. | 29/727 |
| 2009/0224021 | A1 * | 9/2009 | Jensen | 226/183 |
| 2012/0222293 | A1 | 9/2012 | Ueda et al. | |
| 2013/0160516 | A1 * | 6/2013 | Karasawa et al. | 72/338 |

FOREIGN PATENT DOCUMENTS

| | | | |
|---|---|---|---|
| JP | 6-211394 | A | 8/1994 |
| JP | 08-001248 | A | 1/1996 |
| JP | 2012-183554 | A | 9/2012 |
| KR | 10-2012-0100809 | A | 9/2012 |

* cited by examiner

MANUFACTURING APPARATUS FOR FLATTENED TUBE FINS

CROSS-REFERENCE TO RELATED APPLICATION(S)

This application is based upon and claims the benefit of priority of the prior Japanese Patent Application No. 2012-239815, filed on Oct. 31, 2012, the entire contents of which are incorporated herein by reference.

FIELD

The present invention relates to a manufacturing apparatus for flattened tube fins that manufactures heat exchanger fins that use flattened tubes.

BACKGROUND

An existing heat exchanger, such as an air conditioner, is typically constructed by stacking a plurality of heat exchanger fins, in which a plurality of through-holes have been formed to enable heat exchanger tubes to be inserted. Such heat exchanger fins are manufactured by a manufacturing apparatus for heat exchanger fins depicted in FIG. 6. The manufacturing apparatus for heat exchanger fins is equipped with an uncoiler 12 where a thin metal plate 10 made of aluminum or the like has been wound into a coil. The thin plate 10 pulled out from the uncoiler 12 via pinch rollers 14 is inserted into an oil applying apparatus 16, where machining oil is applied onto the surface of the thin plate 10, and is then supplied to a mold apparatus 20 provided inside a press apparatus 18.

The mold apparatus 20 internally includes an upper mold die set 22 that is capable of up-down movement and a lower mold die set 24 that is static. A plurality of collar-equipped through-holes (not illustrated), where collars of a predetermined height are formed around through-holes, are formed at predetermined intervals in a predetermined direction by the mold apparatus 20. The result of machining the thin metal plate to produce the through-holes and the like is hereinafter referred to as the "metal strip 11".

The metal strip 11 that is machined here is formed with a plurality of heat exchanger fins as products aligned in the width direction. For this reason, an inter-row slit apparatus is provided inside the mold apparatus 20. In the inter-row slit apparatus, an intermittently fed metal strip 49 is cut by upper blades and lower blades coming together so as to manufacture products (referred to below as "metal strips of the product width") in the form of long strips in the conveying direction.

The metal strips of the product width are cut into predetermined lengths by a cutter 26. The products that have been cut into the predetermined lengths (i.e., the heat exchanger fins) are then stacked in a stacker 28. The stacker 28 has a plurality of pins 27 that are erected in the perpendicular direction and stacks the manufactured heat exchanger fins with the pins 27 inserted into the through holes.

Patent Document 1

Japanese Laid-Open Patent Publication No. H06-211394

SUMMARY

Existing heat exchanger fins have a plurality of through-holes into which heat-exchanger tubes are inserted, formed in a metal strip. However, heat exchangers that use multi-channel flattened tubes have also been recently developed. Fins for a heat exchanger that uses such flattened tubes (hereinafter sometimes referred to as "flattened tube fins") are depicted in FIGS. 7A and 7B.

On a flattened tube fin 30, cutaway portions 34 into which flattened tubes are inserted are formed at a plurality of positions, and plate-like portions 36, where louvers 35 are formed, are formed between cutaway portion 34 and cutaway portion 34. The cutaway portions 34 are formed from only one side in the width direction of a fin 30. Accordingly, the plurality of plate-like portions 36 between cutaway portion 34 and cutaway portion 34 are joined by a joining portion 38 that extends along the length direction.

However, in a manufacturing apparatus that manufactures flattened tube fins, at the cutoff apparatus that forms the heat exchanger fins as the products by cutting the metal strips of the product width into predetermined lengths, to enable the lengths of the products to be arbitrarily changed, it is possible to set the feeding length per single cutoff operation longer than the feeding length of the metal strips of the product length per operation of the press apparatus (that is, per closing of the mold). For this reason, investigations are being conducted into allowing the metal strips of the product width to sag downward so that a length that is longer than the length of one feeding operation by the cutoff apparatus can be temporarily held between the press apparatus and the cutoff apparatus.

If the metal strips of the product width are allow to sag downward, to always maintain a certain amount of sagging, it is necessary to control the balance between the drawing-in amount of the metal strips of the product width at the cutoff apparatus and the feeding-out amount of the metal strips of the product width from the press apparatus. For this reason, investigations have been made into providing a photoelectric sensor for detecting the position in the up-down direction of the sagging metal strips of the product width. However, since holes such as the cutaway portions 34 and the louvers 35 are formed in the sagging metal strips of the product width, there is the problem that if light becomes incident on such holes, the light will pass through the metal strips, which means that it is not possible to correctly detect the position in the up-down direction of the sagging metal strips of the product width using a photoelectric sensor.

The present invention was conceived to solve the problem described above and has an object of providing a manufacturing apparatus for flattened tube fins that is capable, during the manufacturing of flattened tube fins, of reliably controlling the sagging amount of the metal strips of the product width.

A flattened tube fin manufacturing apparatus according to the present invention manufactures flattened tube fins in which cutaway portions, into which flattened tubes for heat exchanging are inserted, are formed from one side toward another side in a width direction and includes: a press apparatus equipped with a mold apparatus that forms the cutaway portions in an unmachined thin plate of metal to produce a metal strip; an inter-row slit apparatus which cuts the metal strip, in which the cutaway portions have been formed, into predetermined widths to form a plurality of metal strips of a product width that are arranged in the width direction; a first feeding apparatus that feeds the metal strips of the product width formed by the inter-row slit apparatus downstream; and a cutoff apparatus equipped with a cutting apparatus that cuts each of the plurality of metal strips of the product width formed by the inter-row slit apparatus into predetermined lengths and a second feeding apparatus that feeds each of the plurality of metal strips of the product width formed by the inter-row slit apparatus toward the cutting apparatus, wherein the plurality of metal strips of the product width outputted from the inter-row slit apparatus are provided so as to advance into the cutoff apparatus after entering a downwardly sagging state, and the flattened tube fin manufacturing apparatus further includes a control unit that controls a feeding amount of the second feeding apparatus based on data relating to a feeding amount of the first feeding apparatus. By using this construction, it is possible to reliably control the sagging amount of the metal strips of the product width in the sagging state and unnecessary to use a detection device such as a photoelectric sensor, which means that the number of parts can be reduced, thereby contributing to a reduction in cost.

The control unit may control the feeding amount of the second feeding apparatus so that a position in the up-down direction of the plurality of metal strips of the product width in the downwardly sagging state is within a predetermined range. By using this construction, it is possible to always keep the sagging amount of the plurality of metal strips of the product width in the sagging state in a proper state.

The manufacturing apparatus may further include a support portion that contacts lower surfaces of the plurality of metal strips of the product width in the downwardly sagging state to support the plurality of metal strips of the product width, and an up-down movement device that moves the support portion in the up-down direction. The control unit may control the up-down movement device based on data relating to the feeding amount of the first feeding apparatus and data relating to the feeding amount of the second feeding apparatus so that the support portion contacts the lower surfaces of the plurality of metal strips of the product width in the downwardly sagging state. By using this construction, it is possible to support the lower surfaces of the sagging metal strips of the product width with the support portion and prevent deformation of metal strips of the product width that have been formed especially thinly.

The support portion may include a plurality of contact surfaces that contact respective lower surfaces of the plurality of metal strips of the product width, the respective contact surfaces may be formed so as to be inclined so that side surfaces of the metal strips of the product width where the cutaway portions are formed are positioned higher and side surfaces where the cutaway portions are not formed are positioned lower, and side walls that contact the side surfaces of the metal strips of the product width where the cutaway portions are not formed may be formed on the contact surfaces. That is, since the strength of the side surfaces where the cutaway portions are formed is low, it is preferable for such surfaces to not come into contact with any other members. For this reason, the side surfaces where the cutaway portions are formed are position on the upper sides of the inclined surfaces so as to not come into contact with anything and the sides where the cutaway portions are not formed move down the inclines of the contact surfaces under their own weight and are supported by the side walls. This means that it is possible to reliably support the metal strips of the product width with the support portion and to prevent deformation of the sides where the cutaway portions are formed.

According to the present invention, since it is possible, when manufacturing flattened tube fins, to reliably control the sagging amount of the metal strips of the product width in the sagging state and it is also unnecessary to use a detection device such as a photoelectric sensor, the number of parts can be reduced, which contributes to a reduction in cost.

DESCRIPTION OF EMBODIMENT(S)

Figure 1:
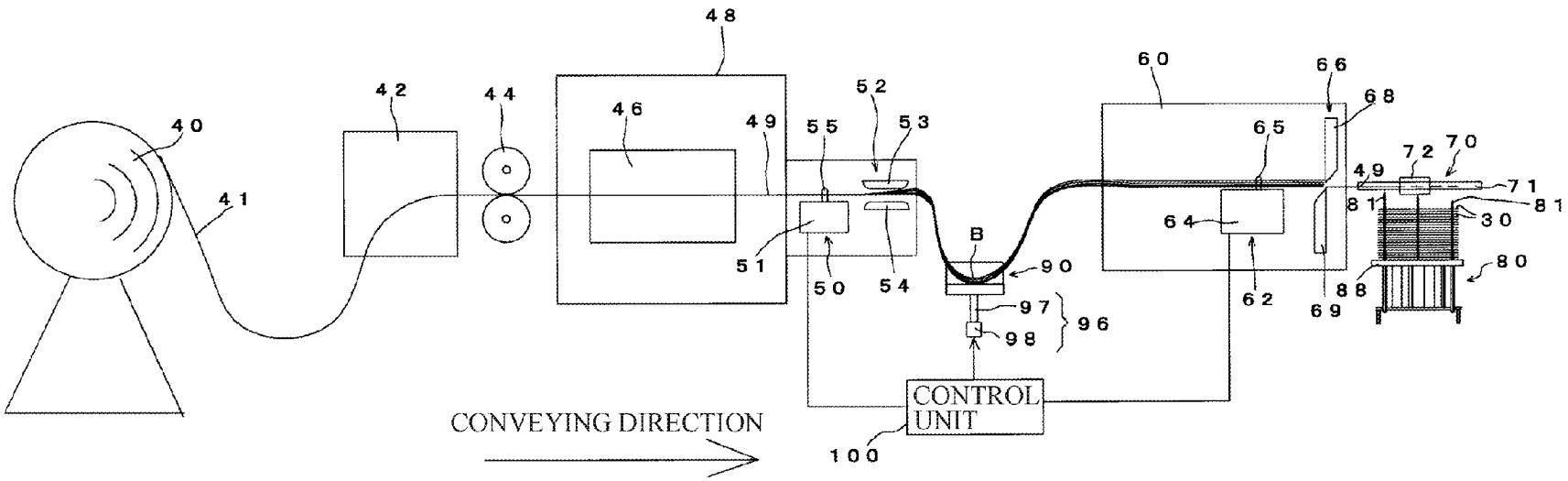
FIG. 1 is a side view depicting the overall configuration of a manufacturing apparatus for flattened tube fins.

The overall configuration of a manufacturing apparatus for flattened tube fins according to an embodiment of the present invention is depicted in FIG. 1. A thin metal plate 41 that is made of aluminum or the like and is yet to be machined is wound in a coil in an uncoiler 40. The thin plate 41 pulled out from the uncoiler 40 is inserted into a loop controller 42, and fluctuations in the thin plate 41 that is intermittently fed out are suppressed by the loop controller 42.

An NC feeder 44 is provided downstream of the loop controller 42. The NC feeder 44 is composed of two rollers that touch the upper surface and the lower surface of the thin plate 41. By rotationally driving the two rollers of the NC feeder 44, the thin plate 41 is sandwiched and intermittently fed. A press apparatus 48 that has a mold apparatus 46 disposed inside is provided downstream of the NC feeder 44. Using the press apparatus 48, the thin plate 41 is formed into a metal strip 49 of a predetermined shape by the mold apparatus 46.

Figure 2:
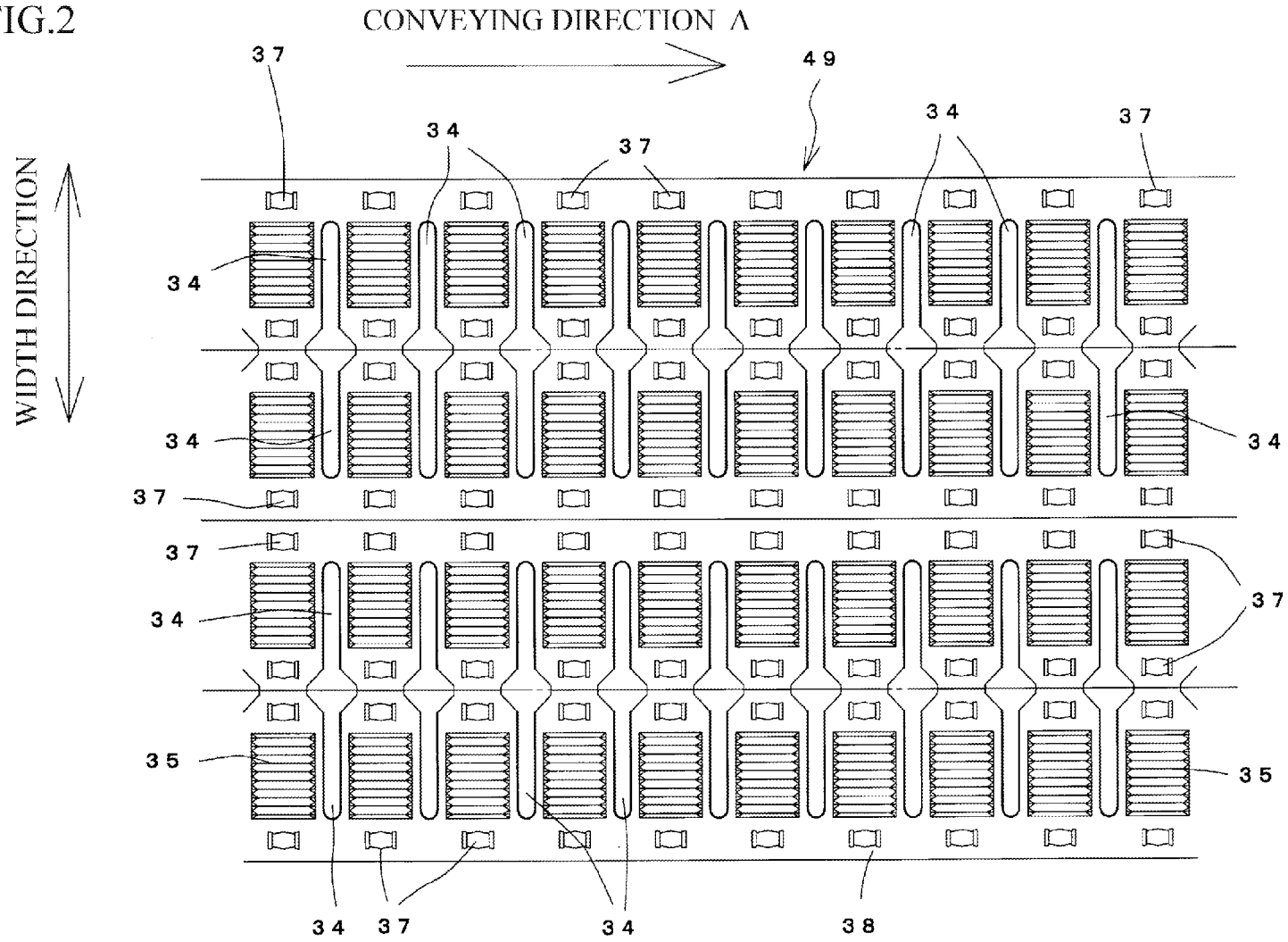
FIG. 2 is a plan view of a metal strip that has been machined by a mold apparatus in FIG. 1.
Figures 7A, 7B:
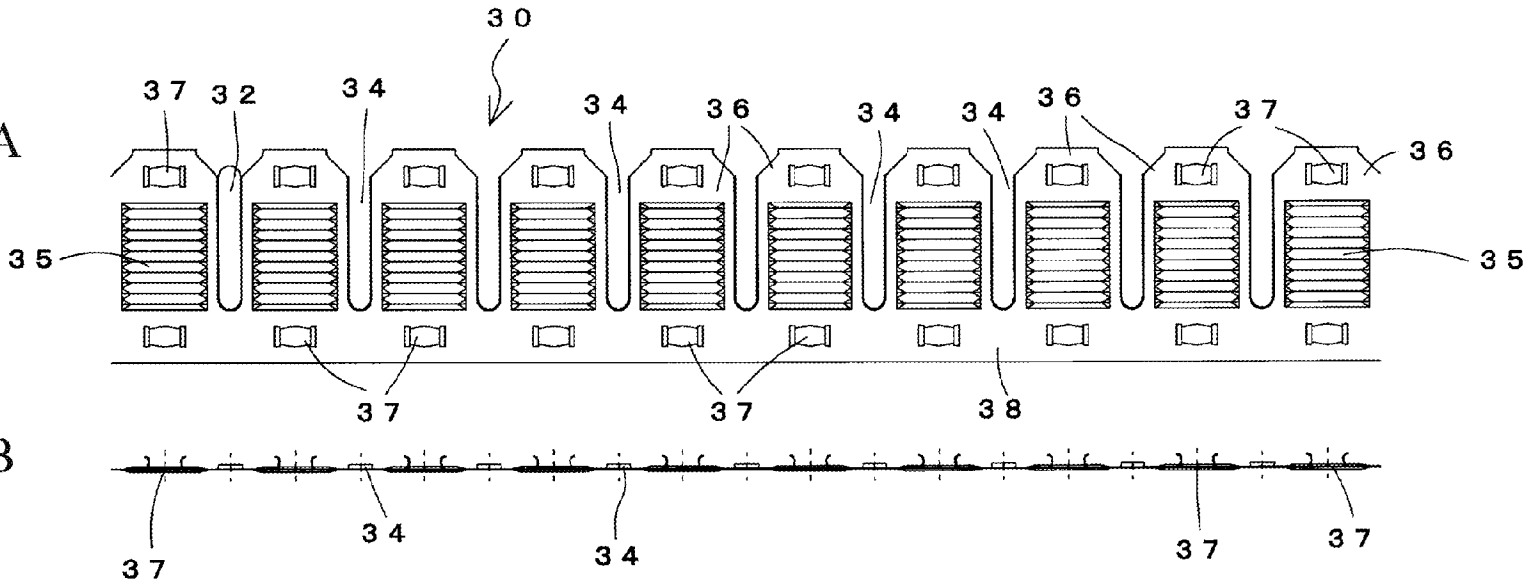
FIG. 7A is a plan view of a flattened tube fin and FIG. 7B is a side view of the flattened tube fin.

The metal strip 49 formed here is depicted in FIG. 2. The metal strip 49 depicted in FIG. 2 has four products formed in a line in the width direction that is perpendicular to the conveying direction A. As depicted in FIG. 7, the specific products of the metal strip 49 each have the cutaway portions 34 into which the flattened tubes 32 will be inserted formed at a plurality of positions and the plate-like portions 36, where louvers 35 are formed, formed between cutaway portion 34 and cutaway portion 34. Openings 37 formed by cutting and folding up the thin metal plate are formed at both end portions in the width direction of the louvers 35. Out of the two openings 37, 37 formed for one louver 35, one opening 37 is formed at a front end side of a plate-like portion 36.

The cutaway portions 34 are formed from only one side in the width direction of each fin 30. Accordingly, the plurality of plate-like portions 36 between cutaway portion 34 and cutaway portion 34 are joined by a joining portion 38 that extends in the length direction. Out of the two openings 37, 37 for one louver 35 described above, the opening 37 on the other side is formed on the joining portion 38.

On the metal strip 49 in FIG. 2, two products disposed with the open ends of the cutaway portions 34 adjacent to one another form a pair, and two of such pairs are formed. That is, the pairs, in which the open ends of the cutaway portions 34 of two products are disposed facing one another, are disposed so that the joining portions 38 thereof are adjacent. In this way, by disposing four products in an alternating arrangement, the left-right load balance of the mold is improved.

Note that unlike a metal strip such as that depicted in FIG. 2, if the open ends of the cutaway portions 34 of a plurality of products were disposed so as to all face in a single direction, when cutting is carried out between the products by an inter-row slit apparatus 52 (described later) that cuts out the products, there would be a high probability that cutting fragments (or "whiskers" or "cutting defects") would be produced between the cutaway portions 34 and the other positions due to displacements in the cutting positions. Accordingly, when the open ends of the cutaway portions 34 of a plurality of products are all disposed so as to face in a single direction, it becomes necessary to cut not at the boundary of the openings of the cutaway portions 34 but to slightly extend the open parts of the cutaway portions 34 as far as a position advanced into a joining portion 38 and to cut at such position. However, in such case, the cross-section becomes stepped and there is deterioration in the left-right load balance of the mold. Accordingly, it is preferable to manufacture a plurality of products with the arrangement depicted in FIG. 2.

The description will now return to the overall construction of the manufacturing apparatus. The metal strip 49 formed by the mold apparatus 46 inside the press apparatus 48 is intermittently fed in the conveying direction by a first feeding apparatus 50 provided downstream of the press apparatus 48. The feed timing of the first feeding apparatus 50 is set so that the first feeding apparatus 50 operates in concert with the NC feeder 44 to enable stable intermittent feeding.

In the first feeding apparatus 50, a reciprocating unit 51 that is capable of moving in the horizontal direction moves reciprocally between an initial position and a conveyed position to pull the metal strip 49. Feed pins 55 that protrude upward are disposed on the upper surface of the reciprocating unit 51, the feed pins 55 advance from below into the cutaway portions 34 formed in the metal strip 49, and the metal strip 49 is moved to the conveyed position by pulling with the feed pins 55.

The inter-row slit apparatus 52 is provided downstream of the feeding apparatus 50. The inter-row slit apparatus 52 includes upper blades 53 disposed on the upper surface side of the metal strip 49 and lower blades 54 disposed on the lower surface side of the metal strip 49. The inter-row slit apparatus 52 may be provided so as to operate using an up-down movement operation of the press apparatus 48. The upper blades 53 and the lower blades 54 are formed so as to be elongated in the conveying direction of the metal strip 49 and the intermittently fed metal strip 49 is cut by the upper blades and the lower blades 54 coming together so as to manufacture products (referred to below as "metal strips of the product width") in the form of long strips in the conveying direction.

The plurality of metal strips 49 of the product width that have been cut to the product width by the inter-row slit apparatus 52 are fed into a cutoff apparatus 60. Note that before feeding into the cutoff apparatus 60, the plurality of metal strips 49 of the product width are disposed with predetermined intervals (which depends on the construction of the stacker apparatus, described later, but around 5 to 10 mm) between neighboring metal strips 49 of the product width. Also, before feeding into the cutoff apparatus 60, sections of the plurality of metal strips 49 of the product width that are longer than the length of one feeding operation by the cutoff apparatus 60 are temporarily held and allowed to sag downward (see symbol B in FIG. 1).

A second feeding apparatus 62 that intermittently conveys the plurality of metal strips 49 of the product width in the conveying direction is provided inside the cutoff apparatus 60. As the construction of the second feeding apparatus 62, a construction where it is possible to set the length of one feeding operation longer than the construction of the first feeding apparatus 50 provided at the downstream side of the press apparatus 48 is used. In the second feeding apparatus 62, a conveying unit 64 that is capable of moving in the horizontal direction moves by a predetermined distance to pull the metal strips 49 of the product width from the press apparatus 48 side and push the metal strips 49 of the product width out toward the downstream side of the cutoff apparatus 60. On the upper surface of the conveying unit 64, a plurality of feed pins 65 are disposed so as to protrude upward and are aligned in the horizontal direction in an equal number of rows to the number of metal strips 49 of the product width. The feed pins 65 advance from below into the cutaway portions 34 formed in the respective metal strips 49 of the product width, and due to being pulled by the feed pins 65, the metal strips 49 of the product width move as far as a conveyed position.

A cutting apparatus 66 is provided downstream of the feeding apparatus 62. The cutting apparatus 66 cuts the respective metal strips 49 of the product width into predetermined lengths to produce the final flattened tube fins 30. The cutting apparatus 66 includes an upper blade 68 disposed on the upper surface side of the metal strips 49 of the product width and a lower blade 69 disposed on the lower surface of the metal strips 49 of the product width. By closing the upper blade 68 and the lower blade 69, the metal strips 49 of the product width are cut into predetermined lengths along the conveying direction to manufacture the flattened tube fins 30.

A plurality of the manufactured flattened tube fins 30 are stacked in a stacker apparatus 80. One example of the stacking of the flattened tube fins will now be described. The flattened tube fins 30 that have been cut to a predetermined dimension by the cutoff apparatus 60 are held by a holder apparatus 70 that maintains a holding state. The stacker apparatus 80 for stacking the flattened tube fins 30 that have been cut into predetermined lengths by the cutoff apparatus 60 is provided below the holder apparatus 70.

The holder apparatus 70 includes a pair of holding members 71 provided so as to be capable of moving toward and away from each other between a side position to the side of the metal strips 49 of the product width fed out from the inter-row slit apparatus 52 and a holding position for the metal strips of the product width. The stacker apparatus 80 includes a plurality of stacker pins 81 capable of moving in the up-down direction so as to be inserted from below through the cutaway portions 34 of the flattened tube fins 30 held by the holder apparatus 70 and a fin receiving portion 88 that contacts the lower surface of a bottom flattened tube fin out of the plurality of flattened tube fins 30 through which the stacker pins 81 have been inserted and is capable of moving in the up-down direction separately to the up-down movement of the stacker pins 81.

The construction of the stacker apparatus is not limited to this example and it is also possible to use a magazine-type construction, for example.

Figure 3:
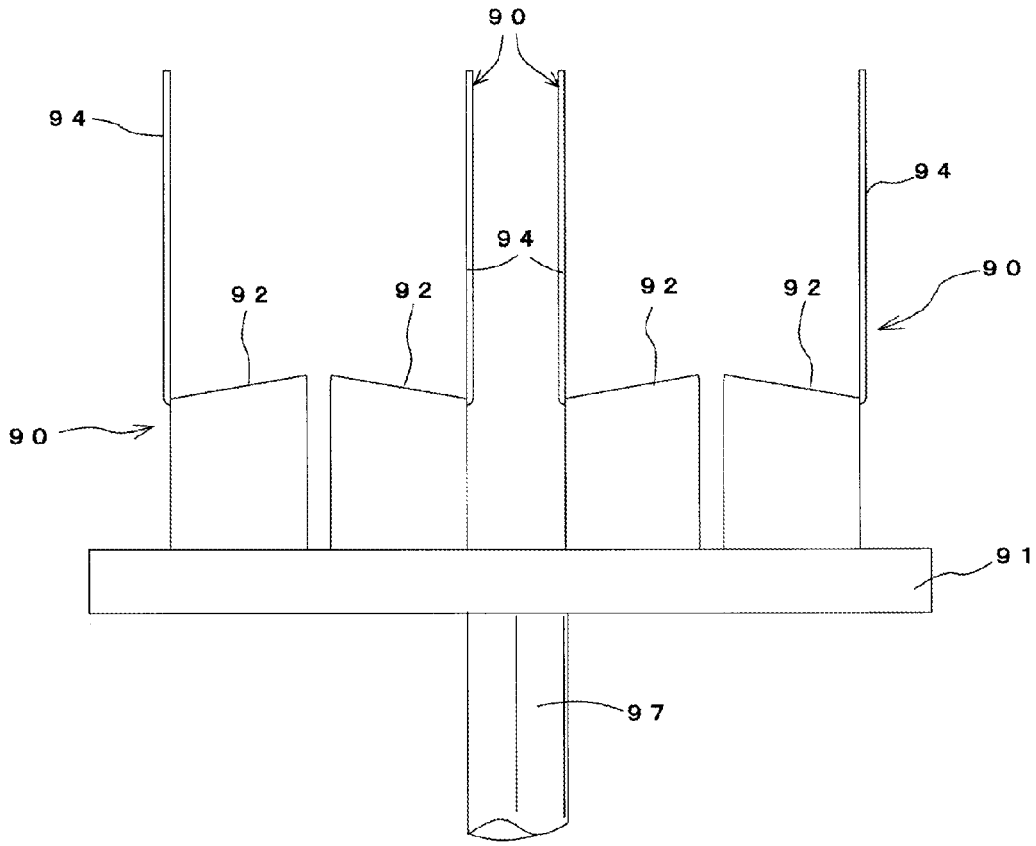
FIG. 3 is a front view of support portions provided between a press apparatus and a cutoff apparatus.

As described earlier, the plurality of metal strips 49 of the product width are allowed to sag downward between the press apparatus 48 and the cutoff apparatus 60. Such sagging parts will sometimes be referred to as the "loops B". A plurality of support portions 90 that support the respective loops B are provided at the lower ends of the loops B. FIG. 3 is a front view of the support portions 90. A support portion 90 is provided for each metal strip 49 of the product width so as to be capable of supporting such metal strip 49 of the product width. Such support portions 90 are disposed on a single base 91 and are capable of moving up and down at the same time as up-down movement of the base 91.

The construction of the respective support portions 90 is described below. The support portions 90 are formed with contact surfaces 92 that contact the lower surfaces of the loops B of the metal strips 49 of the product width. The contact surfaces 92 are formed so as to be inclined in a direction (width direction) that is perpendicular to the conveying direction. Side walls 94 that are upwardly erected are provided at the lower side ends of the inclined contact surfaces 92. Edges in the width direction of the metal strips 49 of the product width contact and are guided by the side walls 94. Note that since the sides of the metal strips 49 of the product width where the cutaway portions 34 are formed are mechanically weak, the side walls 94 are provided so as to not contact the sides where the cutaway portions 34 are formed. That is, the inclination of the contact surface 92 of each support portion 90 is orientated so that the side of a metal strip 49 of the product width where the cutaway portions 34 are not formed (i.e., the side where the joining portion 38 is formed) becomes positioned lower than the other side.

In the example given in the present embodiment, as depicted in FIG. 2, two metal strips 49 of the product width are disposed with the open ends of the cutaway portions 34 adjacent to one another to form a pair, with two of such pairs being formed. For this reason, as depicted in FIG. 3, four support portions 90 are provided in the width direction that is perpendicular to the conveying direction, with the support portions 90 being disposed in two pairs in which the contact surfaces 92 of two support portions 90 are inclined downwardly away from each other in the manner of a roof so that the cutaway portions 34 face one another.

The support portions 90 have an up-down movement device 96 that moves the contact surfaces 92 up and down. A ball screw, a fluid cylinder, and the like can be given as examples of the up-down movement device 96. In the present embodiment, a ball screw 97 is used as the up-down movement device 96. The ball screw 97 is attached to a center of the base 91 and extends downward from the base 91. A servo motor 98 is provided to rotate the ball screw 97. The rotational shaft of the servo motor 98 may directly rotate the ball screw 97, or if the servo motor 98 is disposed at a different position to the axis of the ball screw 97, the ball screw 97 may be rotated by a belt or the like suspended on the rotational shaft of the servo motor 98. In this way, it is possible to precisely control the up-down movement of the support portions 90 via rotational control of the servo motor 98.

Figure 4:
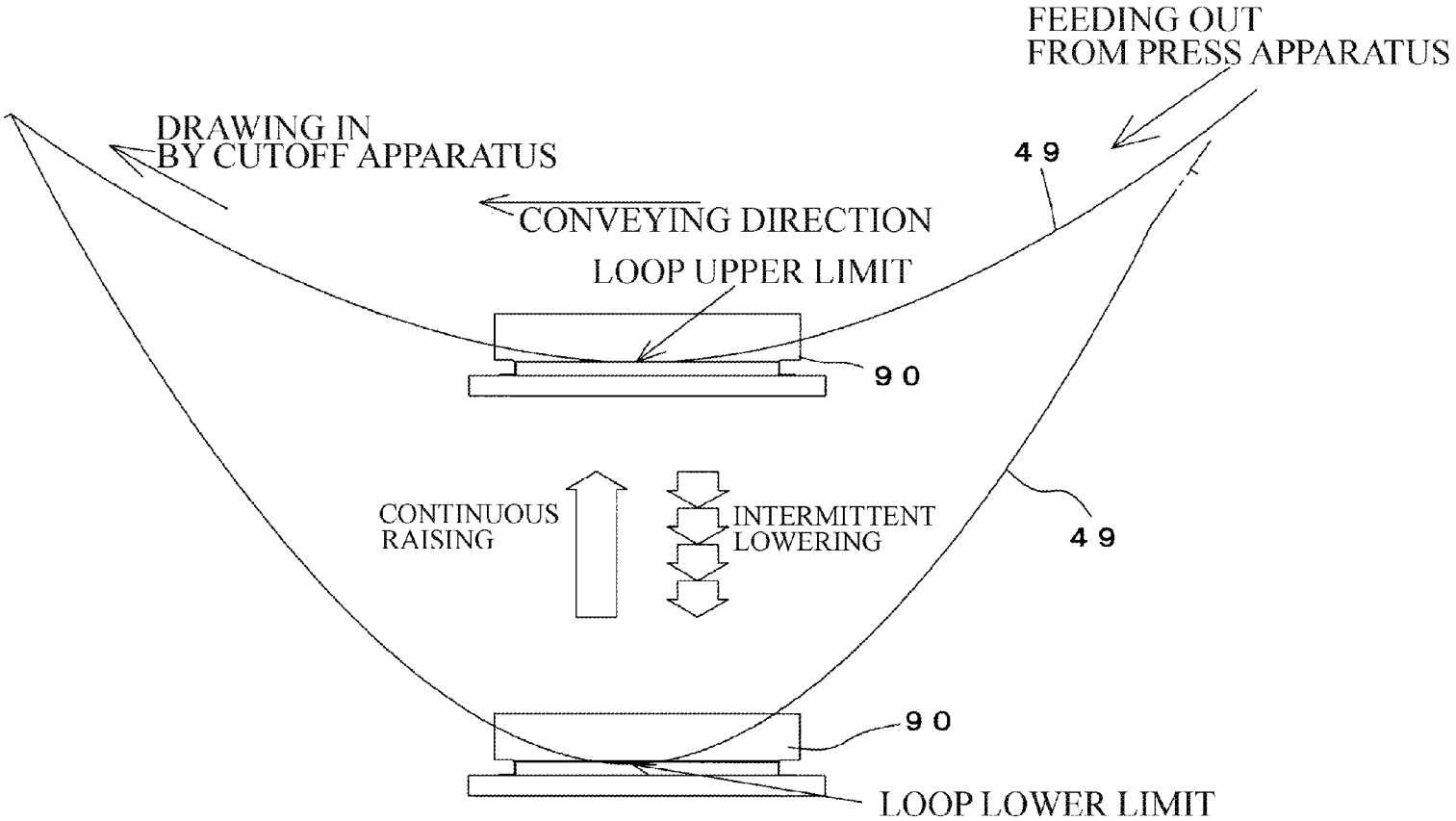
FIG. 4 is a diagram useful in explaining up-down movement of a loop where the metal strips of the product width are allowed to sag.
Figure 5:
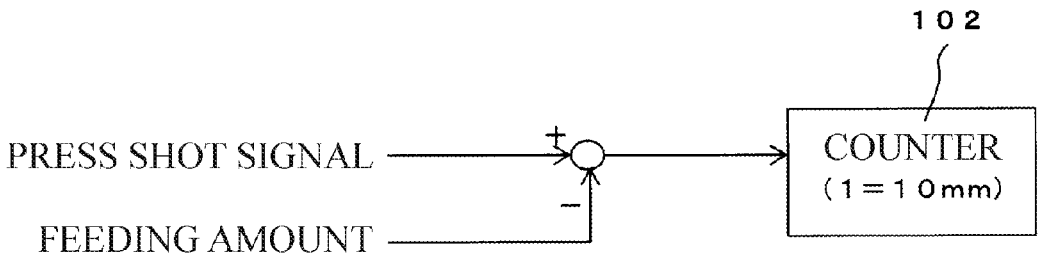
FIG. 5 is a diagram useful in explaining a counter of a control unit.
Figure 6:
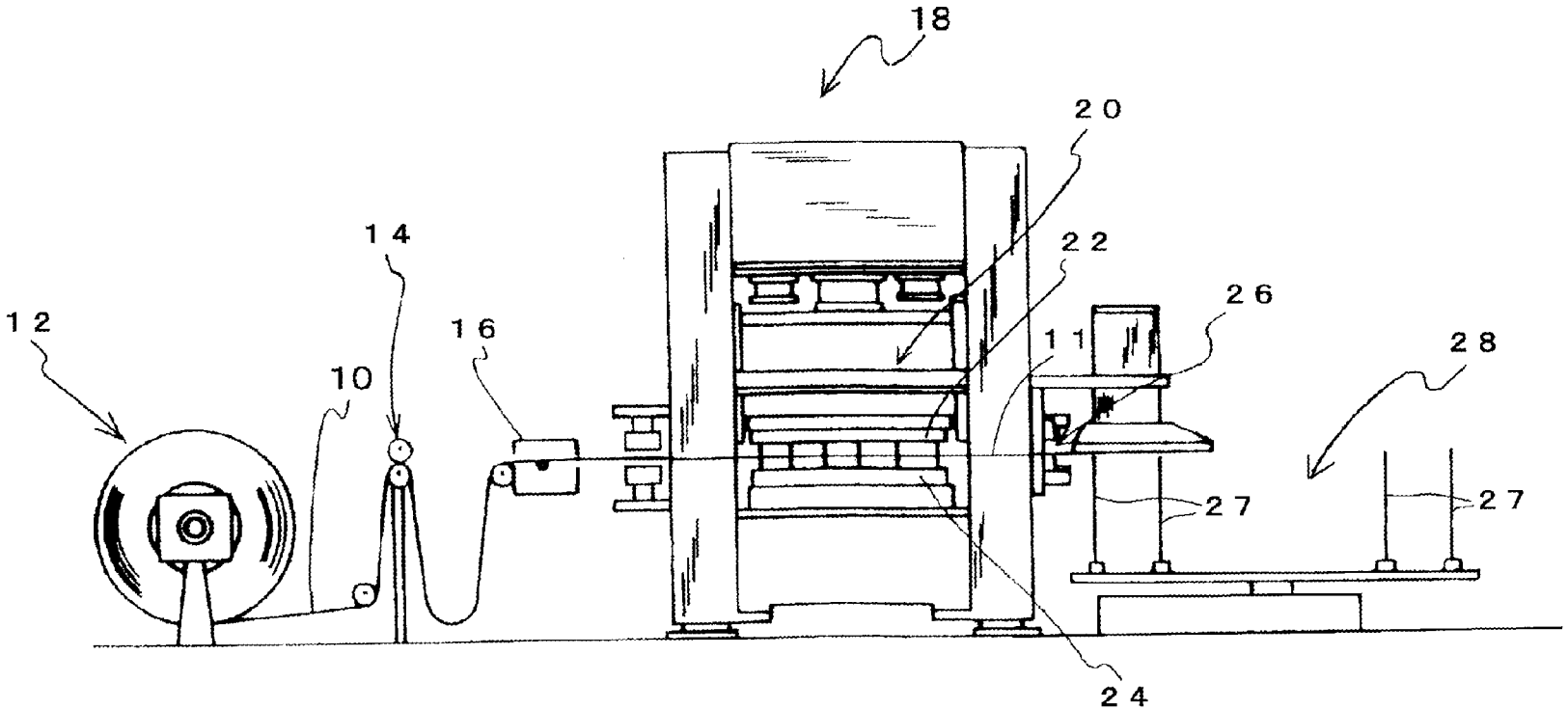
FIG.6 PRIOR ART
FIG. 6 is a diagram useful in explaining the overall construction of a manufacturing apparatus that manufactures heat exchanger fins.

Next, a control method that carries out control over the amount of sagging of the loops B (that is, the position in the up-down direction of the loops B) will be described based on FIGS. 4 and 5. Control of the sagging amount of the loops B can be carried out by controlling the first feeding apparatus 50 for feeding out the metal strips 49 of product width from the press apparatus 48 to the cutoff apparatus 60 and the second feeding apparatus 62 for drawing the metal strips 49 of product width from the loops B into the cutoff apparatus 60. That is, control of the sagging amount of the loops B can be carried out by having the control unit 100 carry out control over the feeding by the second feeding apparatus 62 based on the feeding amount of the first feeding apparatus 50. The control unit 100 is constructed of a central processing apparatus, such as a CPU and a memory or the like that stores an operation program and the like.

A "press shot" signal is inputted as feeding amount data from the first feeding apparatus 50 into the control unit 100. The first feeding apparatus 50 operates in synchronization with a press operation of the press apparatus 48. For each press operation, the first feeding apparatus 50 performs one reciprocal operation to feed the metal strips 49 of product width that have been machined out of the press apparatus 48. In the present embodiment, the first feeding apparatus 50 feeds out around 50 mm in one operation in 0.17 seconds. Accordingly, although the feeding out from the press apparatus 48 is intermittent, around 1000 mm is fed out in 3.4 seconds.

The second feeding apparatus 62 draws in around 1000 mm in a single operation of the cutoff apparatus 60 in a 3.4-second cycle. When a press shot signal from the first feeding apparatus 50 has been inputted and the lower surfaces of the loops B have reached a lower limit position set in advance, the control unit 100 controls the operation of the second feeding apparatus 62 so as to start a feed operation by the second feeding apparatus 62. With this operation of the second feeding apparatus 62, the metal strips 49 of the product width are drawn inside the cutoff apparatus 60 by 1000 mm in a single operation. However, the feeding amount of one operation of the second feeding apparatus 62 will change according to the length of the heat exchanger fins that are the final products.

The control unit 100 has a counter 102 and is capable of continuously checking the sagging amount of the loops B. In the present embodiment, when a shot press signal is inputted from the first feeding apparatus 50, the counter 102 counts up by +5 per single shot signal. Here, counting is performed so that the direction where the sagging amount of the loops B increases is plus and the direction where the sagging amount decreases is minus. Also in the present embodiment, one count is set equal to 10 mm. When a signal relating to the feed amount is inputted from the second feeding apparatus 62, "−100" is added to the value of the counter 102 per single input.

When the value of the counter 102 is positive, the sagging amount of the loops B has increased. That is, the lower surfaces of the loops B are at a lower position. Conversely, when the value of the counter 102 is negative, the sagging amount of the loops B has decreased. That is, the lower surfaces of the loops B are at a higher position. While confirming the value of the counter 102, the control unit 100 controls the second feeding apparatus 62 so that the lower surface position of the loops B is within a predetermined range. That is, the control unit 100 carries out control of the feed timing by the second feeding apparatus 62 so that the value of the counter 102 is in a range corresponding to the upper limit position and the lower limit position set in advance.

Control over the raising and lowering of the support portions 90 that support the lower surfaces of the loops B can also be carried out by the control unit 100. As described earlier, 1000 mm is drawn in in a single operation by the second feeding apparatus 62, so that the loops B are raised from the lower limit position to the upper limit position and in the 3.4 seconds until the next drawing-in operation by the cutoff apparatus 60, the loops B are gradually lowered due to the intermittent feeding out from the first feeding apparatus 50 and reach the lower limit position. That is, an operation where the loops B are raised at once and then gradually lowered is repeated.

As described earlier, since the control unit 100 is capable of recognizing the present position of the lower surfaces of the loops B based on the value of the counter 102, the control unit 100 outputs a control signal to the up-down movement device 96 so that the upper surface position of the support portions 90 always matches the lower surface position of the loops B. More specifically, by controlling the direction of rotation and rotational speed of the servo motor 98 that constructs the up-down movement device 96, the control unit 100 controls the raising and lowering of the support portions 90.

Note that the control unit 100 may control the rotational speed of the servo motor 98 so as to raise the support portions 90 at the same speed as the raising speed of the loops B at the same timing as the start of operation by the feeding apparatus 62 of the cutoff apparatus 60 or at timing that is earlier than such start of operation. By doing so, it is possible to prevent a situation where the loops B are raised earlier than the lifting of the support portions 90 and the lower surfaces of the loops B become separated from the contact surfaces 92 of the support portions 90.

Also, although a drawing operation into the cutoff apparatus 60 will recommence 3.4 seconds after the loops B have reached the upper limit position, during such period the metal strips 49 of the product width are fed out intermittently (by around 50 mm at a time once in 0.17 seconds) from the press apparatus 48. This means that the loops B are intermittently lowered from the upper limit position to the lower limit position. The control unit 100 may control the rotational speed of the servo motor 98 so that the support portions 90 are lowered at the same speed as the lowering speed of the loops B at the same timing as the start of a feeding out operation from the press apparatus 48 or at timing that is later than such start of operation. By doing so, it is possible to prevent a situation where the loops B are lowered slower than the lowering of the support portions 90 and the lower surfaces of the loops B become separated from the contact surfaces 92 of the support portions 90.

Note that an example where the up-down movement device 96 is realized by the ball screw 97 and the servo motor 98 has been described as the above embodiment. However, it is also possible to use another device, such as a fluid cylinder, as the up-down movement device.

Although the up-down movement of the loops B is produced by differences in timing between the drawing in by the cutoff apparatus 60 and the feeding out by the press apparatus 48, the drawing-in amount and feeding-out amount are not limited to those given in the embodiment described above.

Although the present invention has been described above by way of the preferred embodiments, the present invention is not limited to such embodiments and it should be obvious that various modifications may be implemented without departing from the scope of the invention.

What is claimed is:

1. A flattened tube fin manufacturing apparatus that manufactures flattened tube fins in which cutaway portions, into which flattened tubes for heat exchanging are inserted, are formed from one side toward another side in a width direction, the manufacturing apparatus comprising:

press apparatus equipped with a mold apparatus that forms the cutaway portions in an unmachined thin plate of metal to produce a metal strip;

an inter-row slit apparatus which cuts the metal strip, in which the cutaway portions have been formed, into predetermined widths to form a plurality of metal strips of a product width that are arranged in the width direction;

a first feeding apparatus that feeds the metal strips of the product width formed by the inter-row slit apparatus downstream;

a cutoff apparatus equipped with a cutting apparatus that cuts each of the plurality of metal strips of the product width formed by the inter-row slit apparatus into predetermined lengths and a second feeding apparatus that feeds each of the plurality of metal strips of the product width formed by the inter-row slit apparatus toward the cutting apparatus, wherein the plurality of metal strips of the product width outputted from the inter-row slit apparatus are provided so as to advance into the cutoff apparatus after entering a downwardly sagging state, the flattened tube fin manufacturing apparatus further comprises a control unit that controls a feeding amount of the second feeding apparatus based on data relating to a feeding amount of the first feeding apparatus, a support portion that contacts lower surfaces of the plurality of metal strips of the product width in the downwardly sagging state to support the plurality of metal strips of the product width, and an up-down movement device that moves the support portion in the up-down direction, wherein the control unit controls the up-down movement device based on data relating to the feeding amount of the first feeding apparatus and data relating to the feeding amount of the second feeding apparatus so that the support portion contacts the lower surfaces of the plurality of metal strips of the product width in the downwardly sagging state.

2. A flattened tube fin manufacturing apparatus according to claim 1, wherein the control unit controls the feeding amount of the second feeding apparatus so that a position in the up-down direction of the plurality of metal strips of the product width in the downwardly sagging state is within a predetermined range.

3. A flattened tube fin manufacturing apparatus according to claim 1, wherein the support portion includes a plurality of contact surfaces that contact respective lower surfaces of the plurality of metal strips of the product width, the respective contact surfaces are formed so as to be inclined so that side surfaces of the metal strips of the product width where the cutaway portions are formed are positioned higher and side surfaces of the metal strips of the product width where the cutaway portions are not formed are positioned lower, and side walls that contact the side surfaces of the metal strips of the product width where the cutaway portions are not formed are formed on the contact surfaces.

* * * * *